US010458730B2

(12) United States Patent
Lorang et al.

(10) Patent No.: US 10,458,730 B2
(45) Date of Patent: Oct. 29, 2019

(54) DRAINAGE SYSTEM FOR A DEHUMIDIFICATION SYSTEM

(71) Applicant: Therma-Stor LLC, Madison, WI (US)

(72) Inventors: Grant M. Lorang, Lake Mills, WI (US); Scott E. Sloan, Sun Prairie, WI (US)

(73) Assignee: Therma-Stor LLC, Madison, WI (US)

( * ) Notice: Subject to any disclaimer, the term of this patent is extended or adjusted under 35 U.S.C. 154(b) by 161 days.

(21) Appl. No.: 15/875,630

(22) Filed: Jan. 19, 2018

(65) Prior Publication Data

US 2019/0226775 A1 Jul. 25, 2019

(51) Int. Cl.

| | |
|---|---|
| ***F28F 17/00*** | (2006.01) |
| ***F24F 1/02*** | (2019.01) |
| ***F24F 3/14*** | (2006.01) |
| ***F24F 13/22*** | (2006.01) |

(52) U.S. Cl.

CPC ..... *F28F 17/005* (2013.01); *F24F 1/02* (2013.01); *F24F 3/14* (2013.01); *F24F 13/222* (2013.01); *F24F 2003/1446* (2013.01)

(58) Field of Classification Search

CPC ..... F28F 17/005; F24F 13/222; F24F 13/22; F24F 3/14; F24F 3/1405; F24F 3/1423; F24F 1/02; F24F 1/027; F24F 2003/1446; D06F 58/206; D06F 58/24; Y02B 30/52; Y02A 20/128

See application file for complete search history.

(56) References Cited

U.S. PATENT DOCUMENTS

| | | | | |
|---|---|---|---|---|
| 3,750,418 | A * | 8/1973 | Maudlin | F25B 39/02 62/290 |
| 4,835,984 | A * | 6/1989 | Vyavaharkar | F25D 21/14 62/285 |
| 4,843,835 | A * | 7/1989 | Goetz | F25D 21/14 62/285 |
| 6,895,770 | B1 * | 5/2005 | Kaminski | F24F 13/222 62/150 |
| 8,869,548 | B2 * | 10/2014 | Piccione | F24F 13/222 62/291 |
| 8,938,981 | B2 * | 1/2015 | Dingle | F24F 3/1405 62/90 |
| 9,205,374 | B2 * | 12/2015 | Black | F24F 3/1405 |
| 2002/0124582 | A1 * | 9/2002 | Oakner | F24F 13/222 62/150 |
| 2010/0275630 | A1 * | 11/2010 | DeMonte | F24F 1/04 62/272 |
| 2012/0158188 | A1 * | 6/2012 | Madala | G01F 23/243 700/276 |

* cited by examiner

*Primary Examiner* — Emmanuel E Duke
(74) *Attorney, Agent, or Firm* — Baker Botts L.L.P.

(57) ABSTRACT

A dehumidifier drainage system includes a primary drain pan and a secondary drain pan. The primary drain pan is disposed at least partially below an evaporator. The primary drain pan includes one or more raised ribs that are configured to at least partially block air flowing across the primary drain pan as the air flows into the evaporator. The secondary drain pan is disposed at least partially between the evaporator and the primary drain pan. The secondary drain pan includes one or more downspouts. Each downspout is configured to funnel water condensed from the evaporator into an area of the primary drain pan that is at least partially surrounded by one of the raised ribs.

20 Claims, 7 Drawing Sheets

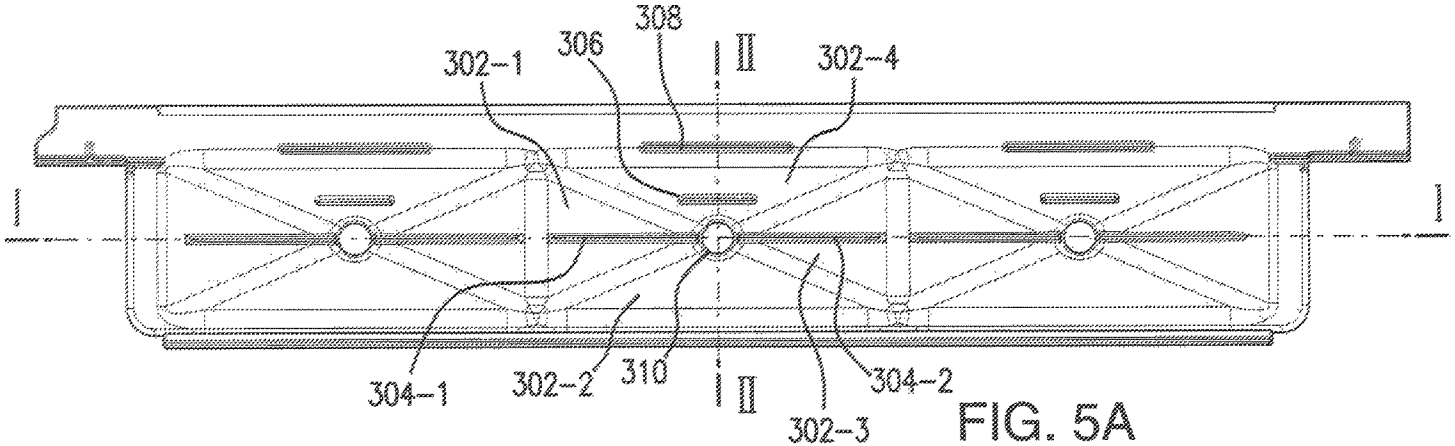
FIG. 5A
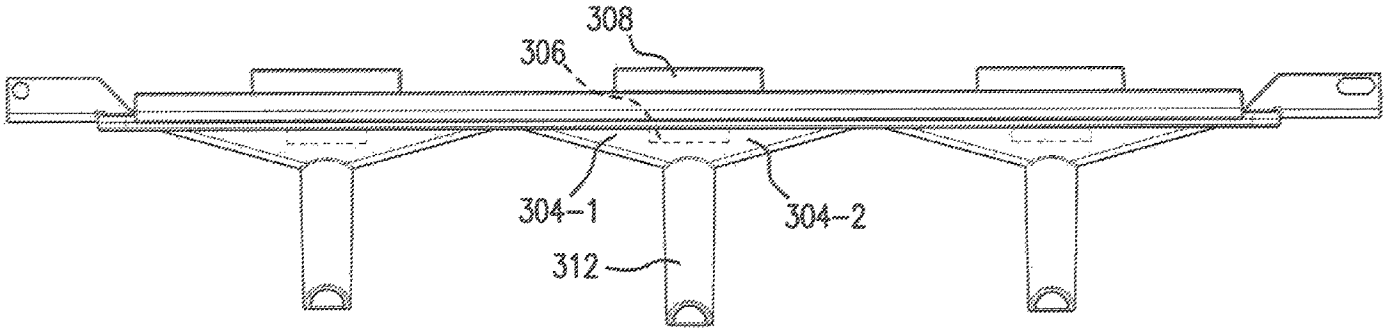
FIG. 5B I-I
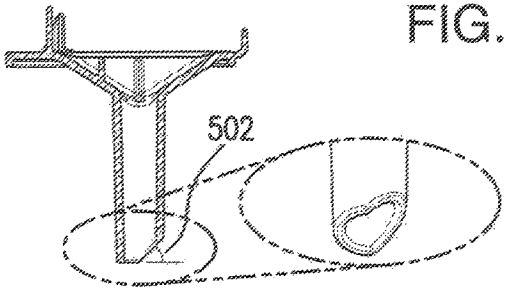
II-II FIG. 5C

DRAINAGE SYSTEM FOR A DEHUMIDIFICATION SYSTEM

TECHNICAL FIELD

This disclosure relates generally to dehumidification, and more particularly to a drainage system for a dehumidification system.

BACKGROUND

In certain situations, it is desirable to increase water removal capacity from a dehumidification system. For example, in fire and flood restoration application, it may be desirable to quickly remove water from areas of a damaged structure. To accomplish this, air flow may be increased through the dehumidification system. However, current dehumidification systems have proven inefficient in increasing water removal capacity.

SUMMARY

According to embodiments of the present disclosure, disadvantages and problems associated with previous dehumidification systems may be reduced or eliminated.

In some embodiments, a dehumidification system includes a heat exchanger, an evaporator, a primary drain pan, a secondary drain pan, a condenser, and an impeller. The evaporator is located adjacent to the heat exchanger. The primary drain pan is located partially below the heat exchanger and partially below the evaporator. The primary drain pan includes one or more raised ribs that are disposed on a bottom surface of the primary drain pan and extend upwards toward the evaporator from the bottom surface. The one or more raised ribs are configured to partially block air flowing across the primary drain pan as the air flows from the heat exchanger into the evaporator. The secondary drain pan is located partially between the evaporator and the primary drain pan. The secondary drain pan includes multiple downspouts. Each of multiple downspouts includes an end that is contoured and is positioned proximate to one of the raised ribs. Each downspout is configured to funnel water condensed from the evaporator into an area of the primary drain pan that is partially surrounded by one of the raised ribs. The condenser is located partially below the primary drain pan. The impeller is located adjacent to the condenser and partially below the primary drain pan.

In some embodiments, a dehumidification system includes an evaporator, a primary drain pan, and one or more secondary drain pans. The primary drain pan is located partially below the evaporator. The primary drain pan includes one or more raised ribs that are disposed on a bottom surface of the primary drain pan and extend upwards toward the evaporator from the bottom surface. The one or more raised ribs are configured to partially block air flowing across the primary drain pan as the air flows into the evaporator. The one or more secondary drain pans are located partially between the evaporator and the primary drain pan. Each of the one or more secondary drain pans includes a downspout configured to funnel water condensed from the evaporator into an area of the primary drain pan that is partially surrounded by one of the raised ribs. The downspout of each secondary drain pans includes an end that is contoured and is positioned proximate to one of the one or more raised ribs.

In some embodiments, a dehumidifier drainage system includes a primary drain pan and a secondary drain pan. The primary drain pan is located partially below an evaporator. The primary drain pan includes one or more raised ribs configured to partially block air flowing across the primary drain pan as the air flows into the evaporator. The secondary drain pan is located partially between the evaporator and the primary drain pan. The secondary drain pan includes one or more downspouts. Each downspout is configured to funnel water condensed from the evaporator into an area of the primary drain pan that is partially surrounded by one of the raised ribs. The downspout of each secondary drain pans includes an end that is contoured and is positioned proximate to one of the one or more raised ribs.

Certain embodiments of the present disclosure may provide one or more technical advantages. For example, the raised ribs on the primary drain pan create localized regions of decreased air velocity by blocking the contoured end of the downspout of the secondary drain pan. This allows water droplets to adhere to the contoured end of the downspout through surface tension, drop into the primary drain pan, and ultimately flow into a drainage outlet. Therefore, the raised ribs create localized barriers in the primary drain pan that prevents water droplets from being entrained in the air stream, thereby improving the efficiency of the dehumidification system.

Other technical advantages of the present disclosure will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and for further features and advantages thereof, reference is now made to the following description taken in conjunction with the accompanying drawings, in which:

FIG. 5A illustrates a top view of the secondary drain pans of FIG. 3, according to certain embodiments;

FIG. 5B illustrates a sectional view of the secondary drain pans of FIG. 3, according to certain embodiments;

FIG. 5C illustrates a sectional view of the secondary drain pans of FIG. 3, according to certain embodiments;

DETAILED DESCRIPTION

Figure 1A:
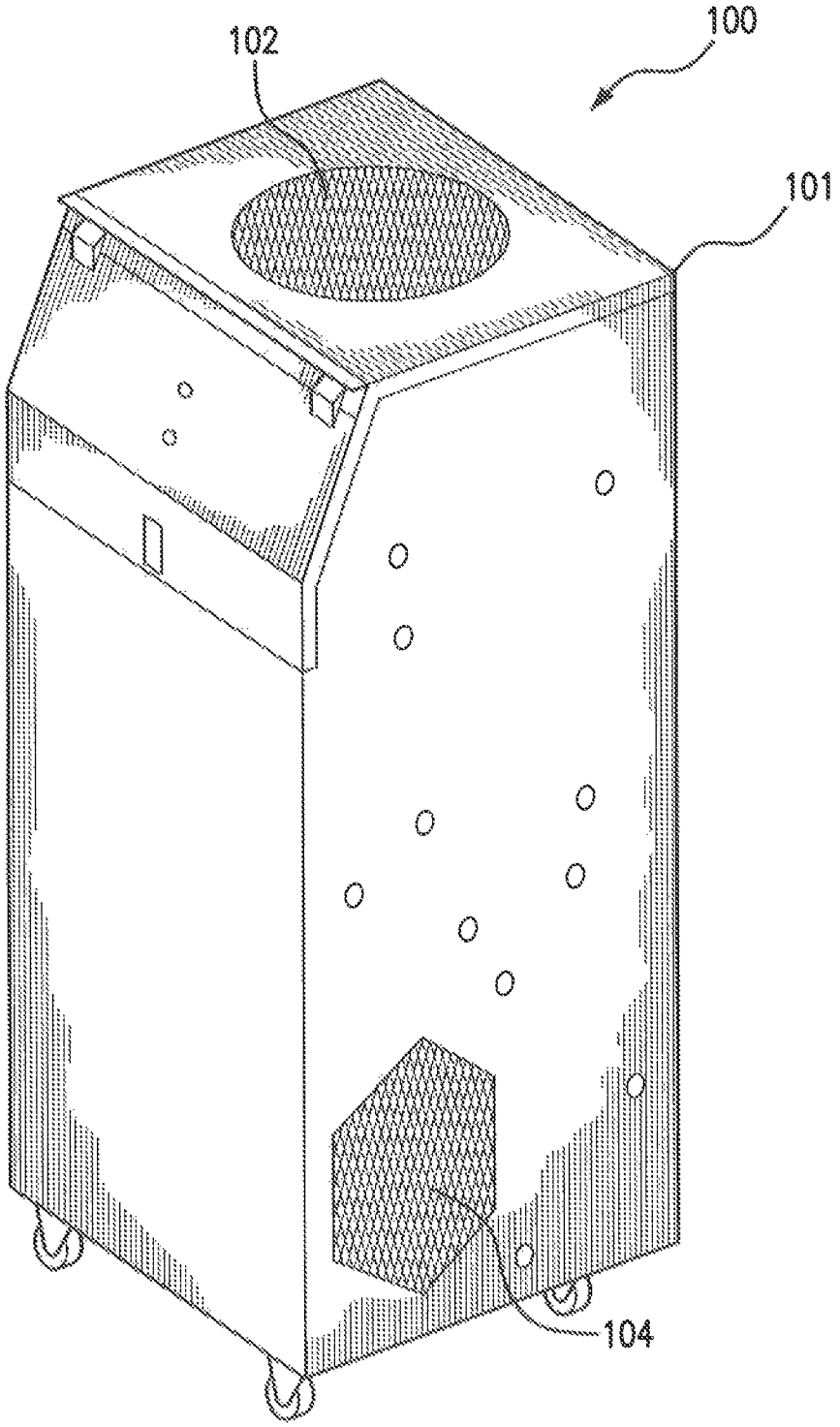
FIG. 1A illustrates a perspective view of a dehumidification system, according to certain embodiments.

In certain situations, it is desirable to increase water removal capacity from a dehumidification system. For example, in fire and flood restoration application, it may be desirable to quickly remove water from areas of a damaged structure. To accomplish this, air flow may be increased through the dehumidification system. However, current dehumidification systems have proven inefficient in increasing water removal capacity. For example, in current dehumidification systems, increasing the air flow through the system may result in localized air velocities that are large enough to pick up water droplets in the air stream. This negatively impacts the dehumidification system performance and durability by allowing water to be reabsorbed into the air and saturating internal components with water.

The disclosed embodiments provide a dehumidification system that includes various features to address the inefficiencies and other issues with current dehumidification systems. In some embodiments, the dehumidification system includes a dehumidification drainage system that is configured to efficiently increase the water removal capacity of the dehumidification system. Specifically, the dehumidification drainage system includes a primary drain pan and one or more secondary drain pans. The primary drain pan is located partially below a heat exchanger and partially below an evaporator to collect water condensed from the heat exchanger and the evaporator. The primary drain pan includes one or more raised ribs configured to partially block air flowing across the primary drain pan as the air flows from the heat exchanger into the evaporator. The one or more secondary drain pans are located partially between the evaporator and the primary drain pan. Each of the secondary drain pans includes a downspout configured to funnel water condensed from the evaporator into an area of the primary drain pan that is partially surrounded by one of the raised ribs.

The downspout of the secondary drain pans includes an end that is contoured and is positioned approximate to one of the raised ribs on the primary drain pan. This configuration of the downspout allows water condensed from the evaporator to form water droplets at the contoured end. The water droplets build up and will drop into an area of the primary drain pan that is partially surrounded by one of the raised ribs. The raised ribs on the primary drain pan create localized regions of decreased air velocity by blocking the contoured end of the downspout. In this way, the raised ribs minimize turbulence caused by air flowing across the primary drain pan, thereby allowing the water droplet to adhere to the contoured end of the downspout through surface tension. Therefore, the raised ribs create localized barriers in the primary drain pan that allows water droplets to gain surface tension which prevents the water droplets from being entrained in the air stream. This allows for higher air flow and greater efficiency in the dehumidification system.

Figure 1B:
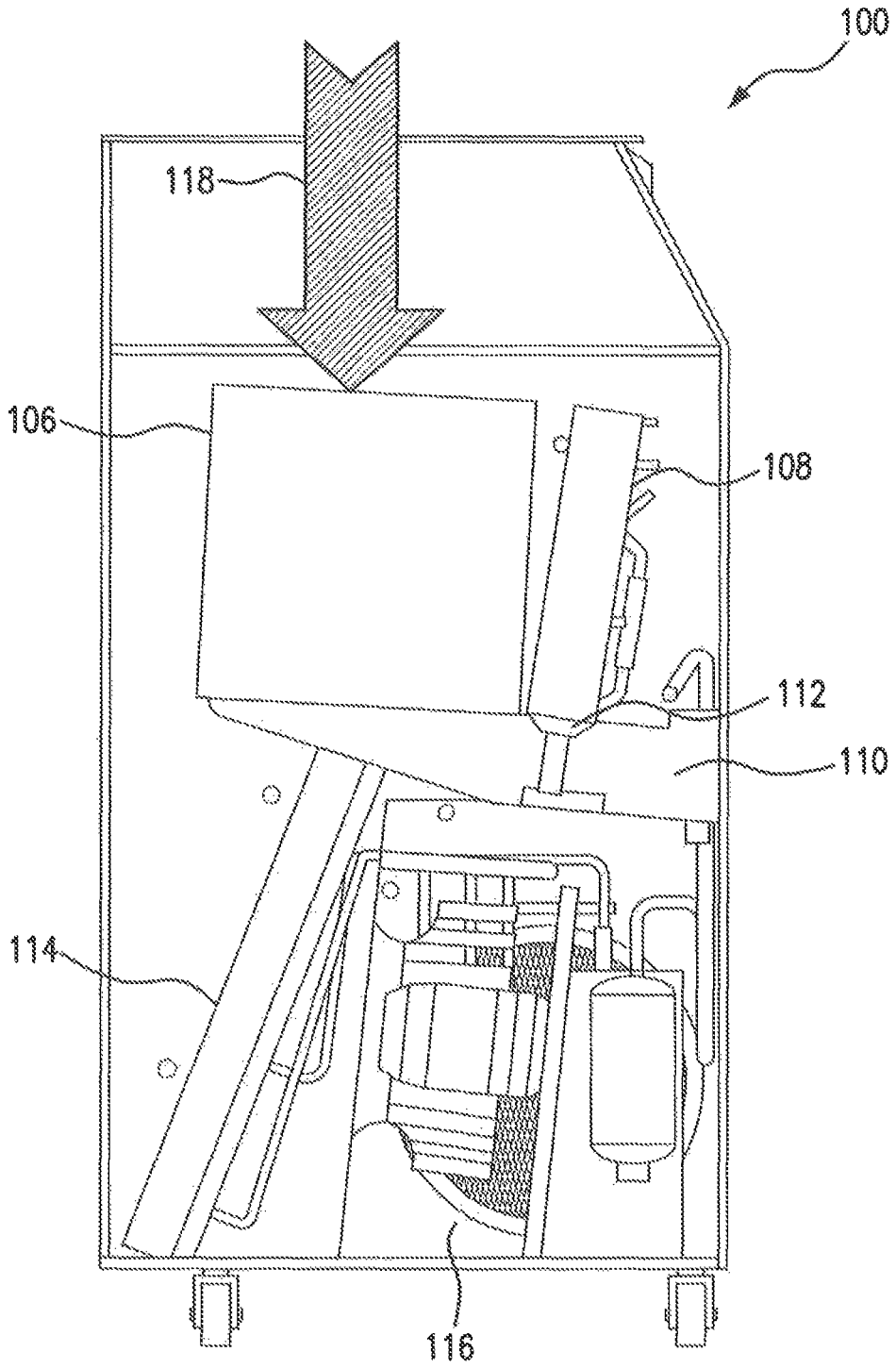
FIG. 1B illustrates a sectional view of the dehumidification system of FIG. 1A, according to certain embodiments.
Figure 2:
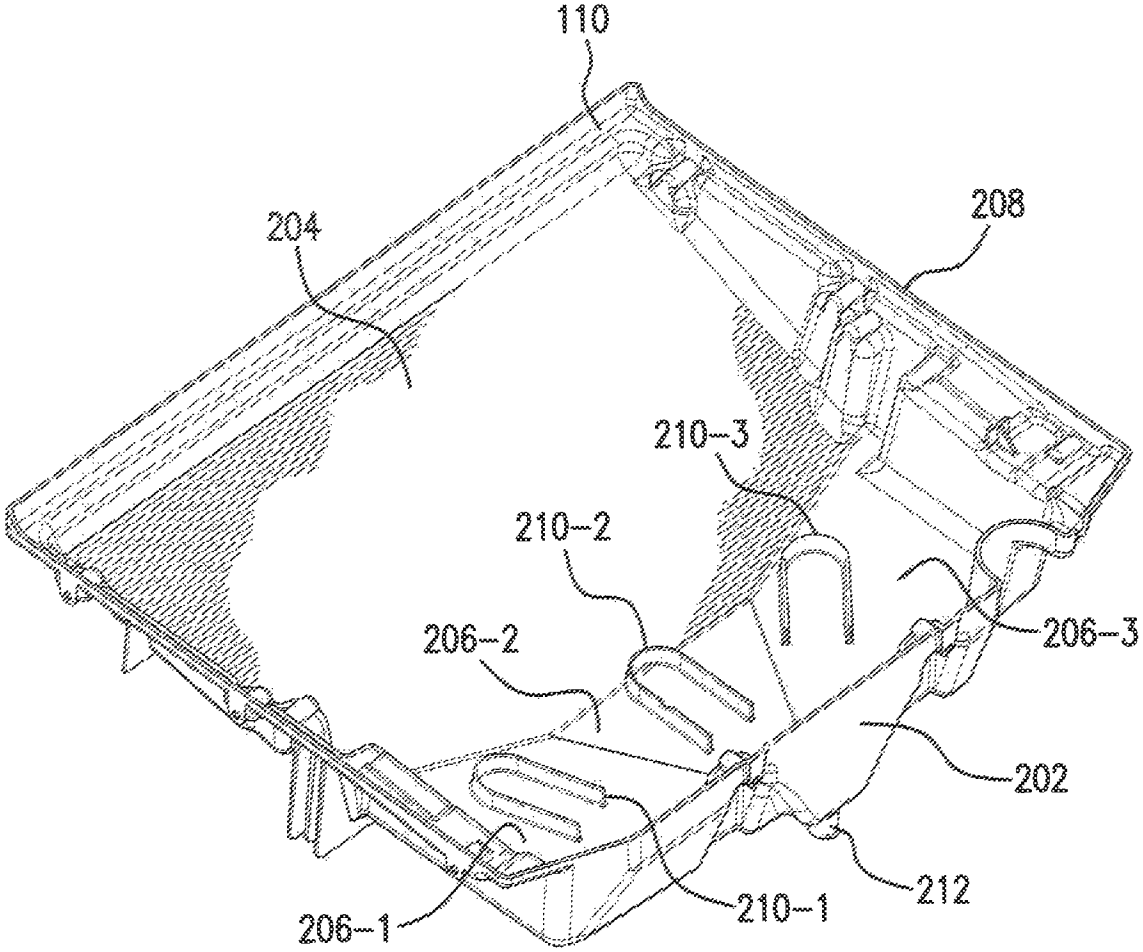
FIG. 2 illustrates a perspective view of primary drain pan in the dehumidification system of FIG. 1B, according to certain embodiments.
Figure 3:
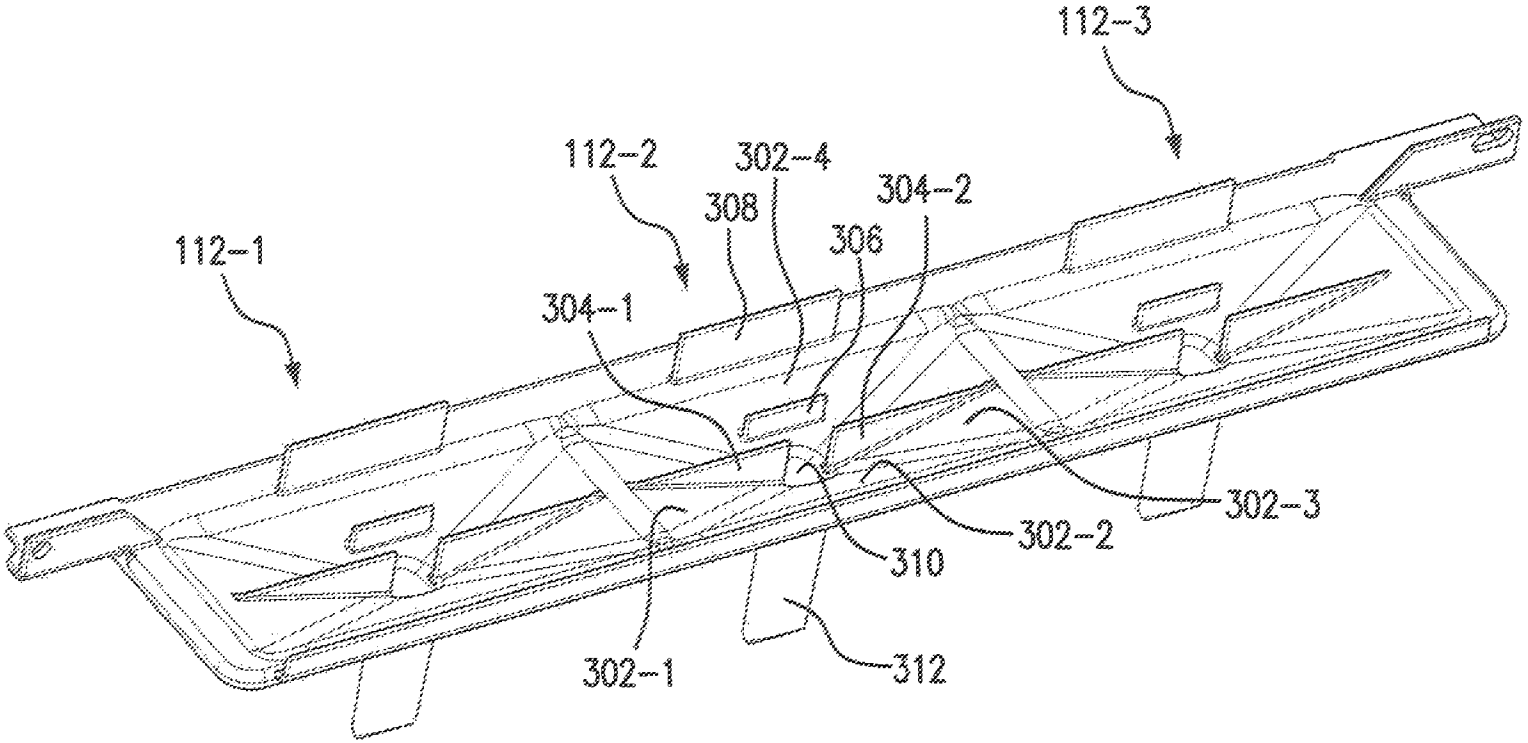
FIG. 3 illustrates a perspective view of secondary drain pans in the dehumidification system of FIG. 1B, according to certain embodiments.
Figure 4A:
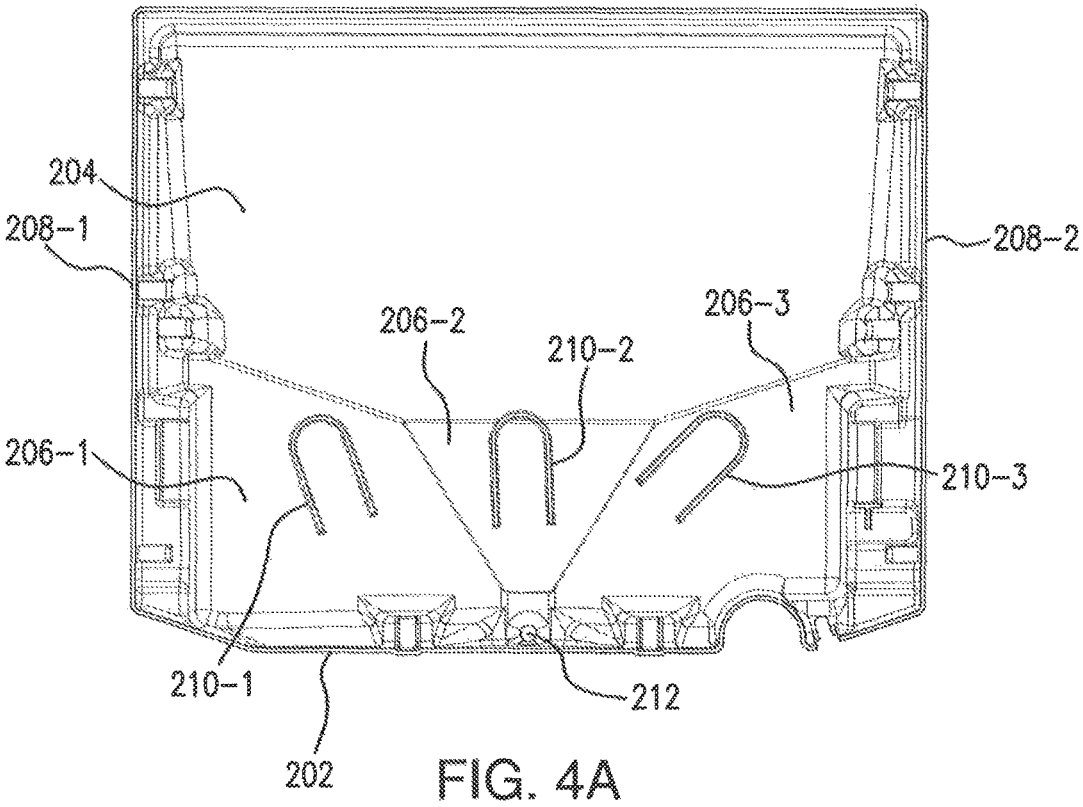
FIG. 4A illustrates a top view of the primary drain pan of FIG. 2, according to certain embodiments.
Figure 4B:
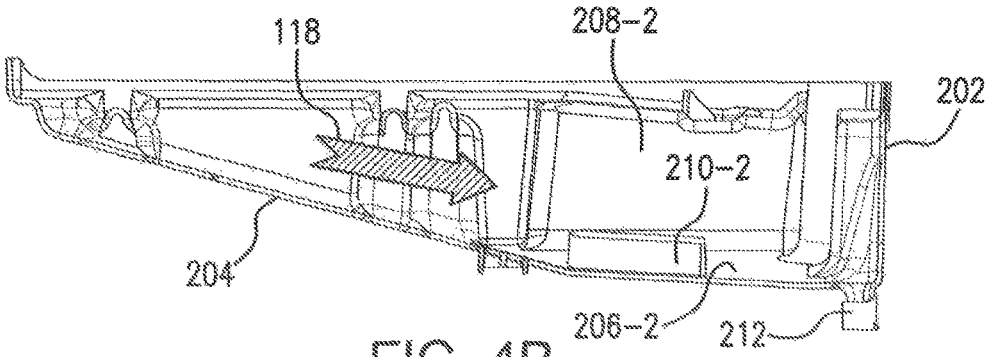
FIG. 4B illustrates a sectional view of the primary drain pan of FIG. 2, according to certain embodiments.
Figure 6A:
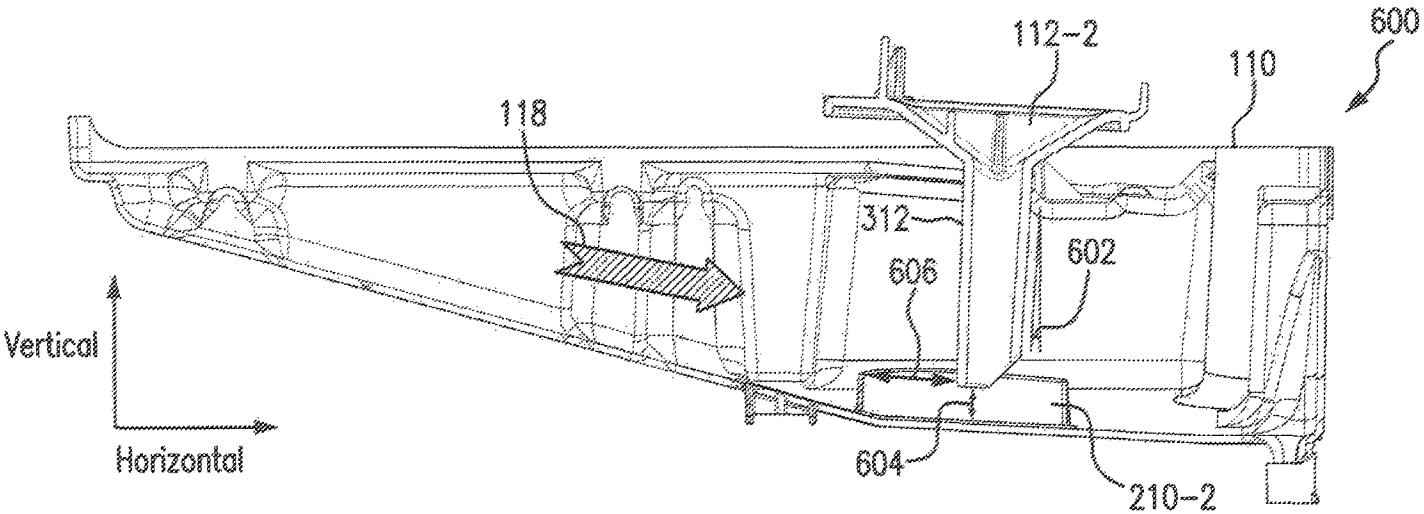
FIG. 6A illustrates a sectional view of a dehumidifier drainage system comprising the primary drain pan of FIG. 2 and the secondary drain pans of FIG. 3, according to certain embodiments.
Figure 6B:
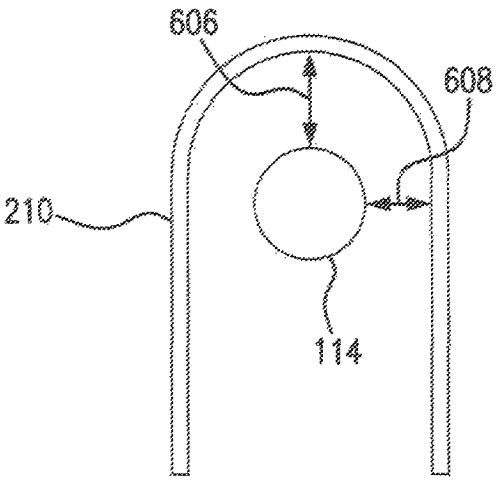
FIG. 6B illustrates a top view of a downspout of the secondary drain pans of FIG. 3 and a raised rib of the primary drain pan of FIG. 2, according to certain embodiments.

These and other advantages and features of certain embodiments are discussed in more detail below in reference to FIGS. 1A-6B. FIG. 1A illustrates a perspective view of certain embodiments of a portable dehumidifier, according to certain embodiments; FIG. 1B illustrates a sectional view of certain embodiments of a dehumidification system; FIG. 2 illustrates a perspective view of certain embodiments of a primary drain pan; FIG. 3 illustrates a perspective view of certain embodiments of secondary drain pans; FIG. 4A illustrates a top view of certain embodiments of a primary drain pan; FIG. 4B illustrates a sectional view of certain embodiments of a primary drain pan; FIG. 5A illustrates a top view of certain embodiments of secondary drain pans; FIG. 5B illustrates a sectional view of certain embodiments of secondary drain pans; FIG. 5C illustrates a sectional view of certain embodiments of secondary drain pans; FIG. 6A illustrates a sectional view of certain embodiments of a dehumidification drainage system comprising a primary drain pan and a secondary drain pan; and FIG. 6B illustrates a top view of certain embodiments of a downspout and a raised rib.

FIGS. 1A and 1B respectively illustrate a perspective view and a sectional view of a dehumidification system 100, according to certain embodiments. In some embodiments, dehumidification system 100 includes a cabinet 101, an airflow inlet 102, an airflow outlet 104, a heat exchanger 106, an evaporator 108, a primary drain pan 110, one or more secondary drain pans 112, a condenser 114, and an impeller 116. While a specific arrangement of these and other components of portable dehumidifier 100 are illustrated in these figures, other embodiments may have other arrangements and may have more or fewer components than those illustrated.

In general, dehumidification system 100 provides dehumidification to an area (e.g., a room, a floor, etc.) by moving air through dehumidification system 100. To dehumidify air, dehumidification system 100 draws in a moist airflow 118 that enters cabinet 101 via airflow inlet 102, travels through other components of dehumidification system 100, and then exits cabinet 101 via airflow outlet 104. Specifically, as illustrated in FIG. 1B, airflow 118 enters cabinet 101 and passes downwards through heat exchanger 106. Airflow 118 is then directed sideways (from left to right), flows across primary drain pan 110, and loops upwards into evaporator 108 where airflow 118 is cooled and the water in airflow 118 condenses and drips down into secondary drain pan 112 by gravity. Water in secondary drain pan 112 may then drop by gravity into primary drain pan 110, where a hose (not shown) connected to primary drain pan 110 guides the water out of dehumidification system 100. Cooled airflow 118 then flows to heat exchanger 106 again. Next, airflow 118 passes through heat exchanger 106 (from right to left) and is directed downwards into condenser 114 where airflow 118 is reheated. Warmed dry airflow 118 is then discharged to the outside by impeller 116 via airflow outlet 104.

Cabinet 101 may be any appropriate shape and size. In some embodiments, cabinet 101 includes multiple panels (or sides). For example, some embodiments of cabinet 101 includes a top panel that includes airflow inlet 102, multiple side panels that include one or more airflow outlet 104, and a bottom panel.

Airflow inlet 102 is generally any opening in which airflow 118 enters dehumidification system 100. In some embodiments, airflow inlet 102 is square or rectangular in shape. In some embodiments, airflow inlet 102 is oval or circular in shape as illustrated. In other embodiments, airflow inlet 102 may have any other appropriate shape or dimensions. In some embodiments, airflow inlet 102 includes a grate or grill that is formed out of geometric shapes. For example, some embodiments of airflow inlet 102 includes a grill formed from hexagons, octagons, and the like. In some embodiments, a removable air filter may be installed proximate to airflow inlet 102 to filter airflow 118 as it enters dehumidification system 100. In some embodiments, airflow inlet 102 is located on a top panel (or top side) as illustrated, but may be in any other appropriate location on other embodiments of dehumidification system 100.

Airflow outlet 104 is generally any opening in which airflow 118 exits dehumidification system 100. Similar to airflow inlet 102, airflow outlet 104 includes a grate or grill that is formed out of geometric shapes such as hexagons, octagons, and the like. In some embodiments, airflow inlet 102 may be square or rectangular in shape, but may have any other appropriate shape or dimensions. In some embodiments, airflow outlet 104 is located on a side panel as illustrated, but may be in any other appropriate location on other embodiments of dehumidification system 100.

Dehumidification system 100 includes various components to provide dehumidification to airflow 118. These and other internal components of dehumidification system 100 are uniquely arranged to minimize the size of dehumidification system 100. In some embodiments, heat exchanger 106 is located proximate to airflow inlet 102. In some embodiments, a removable filter may be provided between heat exchanger 106 and airflow inlet 102 to filter airflow 118 before it enters heat exchanger 106. In some embodiments, evaporator 108 is located adjacent to heat exchanger 106. In some embodiments, primary drain pan 110 is located partially below heat exchanger 106 and partially below evaporator 108. In some embodiments, secondary drain pan 112 is located partially between evaporator 108 and primary drain pan 110. Condenser 114 may be located partially below primary drain pan 110. Impeller 116 may be located adjacent to condenser 114 and partially below primary drain pan 110. Impeller 116 may be also located proximate to airflow outlet 104 to exhaust airflow 118 out of airflow outlet 104.

Heat exchanger 106 is configured to separate airflows between two different directions (e.g., horizontal and vertical) and exchange thermal energy from one air flow to another. For example, in heat exchanger 106, incoming airflow at a vertical direction (e.g., airflow 118 as illustrated in FIG. 1B) and outgoing airflow at a horizontal direction (not shown) are isolated, and no moisture is transferred between the two airflows. In some embodiments, heat exchanger 106 includes a cross-flow plate heat exchanger. In some embodiments, heat exchanger 106 includes multiple thin metal panels made of aluminum. In yet other embodiments, heat exchanger 106 may be any type of heat exchangers such as counter-flow plate heat exchangers, rotary heat exchangers, etc., and may be made of any appropriate material such as plastic, steel, etc.

Evaporator 108 is configured to absorb heat from airflow 118 and condense the moisture in airflow 118. In some embodiments, evaporator 108 includes a finned-tube evaporator comprising tube coils covered with fins. The fins added to the tubes extend into the spaces between the tubes to permit more of airflow 118 to come into contact with cold evaporator 108. This design allows evaporator 108 to be made dimensionally smaller while still providing a reasonable heat transfer capability. During operation, evaporator 108 gets cold enough (below the dewpoint) to pull water out of airflow 118. Water will drip down the coils of evaporator 108 and into secondary drain pan 112. In some embodiments, the tubes and the fins of evaporator 108 are made of copper or aluminum. In yet other embodiments, evaporator 108 may be any type of evaporator such as a bare tube evaporator, a plate evaporator, a microchannel heat exchanger, etc., and may be made of any appropriate material such as aluminum, copper, steel, etc.

Primary drain pan 110 is configured to collect water condensed from heat exchanger 106 and evaporator 108. Primary drain pan 110 is located partially below heat exchanger 106 and partially below evaporator 108. In some embodiments, primary drain pan 110 is any appropriate tank, basin, container, or area within cabinet 101 to collect and hold water removed from airflow 118. In some embodiments, primary drain pan 110 is formed using one or more walls or panels. In some embodiments, primary drain pan 110 includes a bottom which is sloped to allow water condensed from heat exchanger 106 and evaporator 108 to flow down to a drainage port on the bottom. In some embodiments, primary drain pan 110 is made of plastic and is manufactured using an injection molding process. In yet other embodiments, primary drain pan 110 may be made of any appropriate material. A particular embodiment of primary drain pan 110 is described in more detail below in reference to FIGS. 2 and 4A-4B.

Secondary drain pan 112 is configured to funnel water condensed from evaporator 108 into primary drain pan 110. Secondary drain pan 112 is located partially between evaporator 108 and primary drain pan 110. In some embodiments, secondary drain pan 112 includes one or more downspouts. In some embodiments, secondary drain pan 112 is made of plastic and is manufactured using an injection molding process. In yet other embodiments, secondary drain pan 112 may be made of any appropriate material. During operation, water condensed from evaporator 108 flows down a downspout of secondary drain pan 112 and forms water droplets at the bottom end of the downspout. The water droplets build up and drop into primary drain pan 110 by gravity. A particular embodiment of secondary drain pan 112 is described in more detail below in reference to FIGS. 3 and 5A-5C.

Condenser 114 is configured to heat dry airflow 118. In some embodiments, condenser 114 includes a microchannel condenser comprising condenser coils that are made of aluminum in some embodiments. In general, a microchannel condenser provides numerous features including a high heat transfer coefficient, a low air-side pressure restriction, and a compact design (compared to other solutions such as finned tub exchangers). These and other features make microchannel condensers good options for condensers in air conditioning systems where inlet air temperatures are high and airflow is high with low fan power. In some embodiments, condenser 114 includes one condenser coil. In some embodiments, condenser 114 includes two or more condenser coils to achieve a reasonable temperature. In yet other embodiments, condenser 114 may be any type of condensers, and may be made of any appropriate material.

Evaporator 108 and condenser 114 make it possible to complete the heat exchange process. Cold evaporator 108 condenses the water in airflow 118, which is removed, and then airflow 118 is reheated by the condenser coils of condenser 114. The now dehumidified, re-warmed air is released into the environment.

During operation, incoming airflow (e.g., airflow 118 as illustrated in FIG. 1B) travels down and passes through heat exchanger 106 and hits primary drain pan 110. The airflow is directed sideways (from left to right in the figure) in primary drain pan 110. The airflow is then directed upwards at the right side of primary drain pan 110 and loops into evaporator 108 where the airflow is cooled and water is removed from the airflow. Next, the dry airflow goes back to heat exchanger 106 (from right to left). Heat exchanger 106 separates the airflows between vertical and horizontal directions so that they are never mixed. The water removed from the airflow drips down the coils of evaporator 108 and falls into secondary drain pan 112. Secondary drain pan 112 subsequently funnels the water to primary drain pan 110. The water then flows down to a drainage port on the bottom of primary drain pan 110. A hose (not shown) connected to the drainage port will guide the water out of dehumidification system 100.

Dehumidification system 100 further includes an impeller 116 that, when activated, draws airflow 118 into dehumidification system 100 via airflow inlet 102, causes airflow 118 to flow through dehumidification system 100, and exhausts airflow 118 out of airflow outlet 104. In some embodiments, impeller 116 is located within cabinet 101 proximate to airflow outlet 104 as illustrated in FIG. 1B. In some embodiments, impeller 116 is a backward inclined impeller configured to generate airflow 118 that flows through dehumidification system 100 for dehumidification and exits dehumidification system 100 through airflow outlet 104. In some embodiments, impeller 116 may be any other type of air mover (e.g., axial fan, forward inclined impeller, etc.) in other embodiments of dehumidification system 100.

Some embodiments of dehumidification system 100 may include two or more wheels. Wheels may be of any size and be made of any appropriate materials. Some embodiments of dehumidification system 100 also includes a control panel located in cabinet 101. In general, the control panel provides various controls for an operator to control certain functions of dehumidification system 100. In some embodiments, the control panel is located on top side of a side panel. In some embodiments, the control panel may be located in any appropriate location on cabinet 101.

In some embodiments, dehumidification system 100 includes a storage compartment (not shown) within cabinet 101. In general, the storage compartment provides a convenient location for operators to store hoses, cords, and other items needed for the operation of dehumidification system 100.

FIG. 2 illustrates primary drain pan 110 of dehumidification system 100, according to certain embodiments. In some embodiments, primary drain pan 110 includes a front panel 202, a back panel 204, three bottom panels 206-1, 206-2, 206-3, two side panels 208, raised ribs 210-1, 210-2, 210-3 disposed on bottom panels 206, and a drainage outlet 212. In some embodiments, primary drain pan 110 may include more or fewer components than those illustrated. For example, in certain embodiments, primary drain pan 110 may include one bottom panel 206 and three raised ribs 210 disposed on bottom panel 206. In yet another embodiment, primary drain pan 110 may include one bottom panel 206 and one raised rib 210 disposed on bottom panel 206.

Referring to FIG. 4A, in some embodiments, bottom panels 206-1, 206-2, and 206-3 are adjoined to form a bottom of primary drain pan 110. Front panel 202 adjoins bottom panels 206 at one side of bottom panels 206 and extends upwards. Back panel 204 adjoins bottom panels 206 at an opposite side of bottom panels 206 with respect to front panel 202. Side panels 208-1 and 208-2 extend upwards from bottom panels 206-1 and 206-2, respectively. Drainage outlet 212 is located on bottom panel 206-2 close to front panel 202. Referring to FIG. 4B, bottom panel 206-2 is sloped at an angle relative to a horizontal direction to allow water to flow down to drainage outlet 212. In some embodiments, bottom panels 206-1 and 206-3 may be also sloped to allow water to flow down to drainage outlet 212. Back panel 204 may be sloped at a larger angle than bottom panel 206-2 to allow water to flow to bottom panel 206-2. Such configuration of front panel 202, back panel 204, bottom panels 206, and side panels 208 is used to retain the condensed water in primary drain pan 110 and further drain the condensed water out of primary drain pan 110 via drainage outlet 112.

Referring back to FIG. 4A, raised ribs 210-1, 210-2, and 210-3 are located on bottom panels 206-1, 206-2, and 206-3 respectively, and extend upwards toward evaporator 108. In some embodiments, raised ribs 210 have a height of approximately ½ inch. In some embodiment, raised ribs 210-1, 210-2, and 210-3 are U-shaped ribs having an opening towards drainage outlet 212. In yet other embodiments, raised ribs 210 may have any other appropriate shapes or dimensions. Referring to FIG. 4B, raised ribs 210 (e.g., 210-2) are configured to partially block airflow 118 flowing across primary drain pan 110 as the air flows from heat exchanger 106 into evaporator 108. Raised ribs 210 create localized air barriers in primary drain pan 110 to prevent water funneled from secondary drain pan 112 from being reabsorbed into airflow 118.

FIG. 3 illustrates secondary drain pans 112 of dehumidification system 100, according to certain embodiments. In some embodiments, dehumidification system 100 includes three secondary drain pans 112 (e.g., 112-1, 112-2, and 112-3) as illustrated, each secondary drain pan 112 comprising four bottom panels 302 (e.g., 302-1, 302-2, 302-3, and 302-4), two center ribs 304 (e.g., 304-1 and 304-2), an intermediate rib 306, a back rib 308, a drainage outlet 310, and a downspout 312. In yet other embodiments, dehumidification system 100 may include more or fewer secondary drain pans 112. In some embodiments, each secondary drain pan 112 may include more or fewer center ribs 304, intermediate ribs 306, and back ribs 308.

In some embodiments, bottom panels 302 are in a triangular shape and are adjoined at two edges to from a bottom of secondary drain pan 112. Bottom panels 302 are sloped to allow water to flow to drainage outlet 310. In some embodiments, center ribs 304 are in a triangular shape. In some embodiments, center ribs 304 have a shape of a right-angled triangle. Referring to FIG. 5A, drainage outlet 310 is surrounded by four bottom panels 302 (e.g., 302-1, 302-2, 302-3, and 302-4). Center ribs 304 (e.g. 304-1 and 304-2) are located on two non-adjoining bottom panels 302 (e.g., 302-1 and 302-3) and extends upwards along a median line of bottom panels 302-1 and 302-3. Note that in some embodiments, center ribs 304-1 and 304-2 do not extend over drainage outlet 310 as illustrated in FIG. 5A. In some embodiments, center ribs 304 may be positioned directly underneath the lowest tube of evaporator 108 and are configured to restrict an area between evaporator 108 and secondary drain pan 112 through which air may pass. In other embodiments, center ribs 304 may not be directly underneath the lowest tube of evaporator 108. Center ribs 304 minimize a gap between evaporator 108 and secondary drain pan 112, which causes the airflow to enter into the tubes and fin grills of evaporator 108 rather than going underneath and picking up the condensed water droplets. In this way, center ribs 304 prevent condensed water from being entrained in the airflow.

As illustrated in FIG. 5A, intermediate rib 306 is located on another bottom panel 302 (e.g., 302-4) which is different from the two bottom panels 302 (e.g., 302-1 and 302-3) on which center ribs 304 sits. In some embodiments, intermediate rib 306 is parallel to center ribs 304 and extends upwards along a midsegment line of bottom panel 302-4. Back rib 308 is located on a same bottom panel 302 (e.g., 302-4) as intermediate rib 306. Back rib 308 extends upwards along an edge of bottom panel 302-4 and is approximately parallel to intermediate rib 306. Intermediate rib 306 and back rib 308 provide another opportunity to prevent condensed water from being entrained in the airflow. For example, water droplets condensed from the coils of evaporator 108 may drip down with a momentum (caused by localized velocity) which makes the water droplets drift sideways and hit intermediate rib 306 and back rib 308. After hitting intermediate rib 306 and back rib 308, water droplets will drop down to bottom panels 302 and flow to drainage outlet 312 wherein they are funneled to primary drain pan 110. In some embodiments, intermediate rib 306 does not extend along a full length of the midsegment line of bottom panel 302, and back rib 308 does not extend along a full length of the edge of bottom panel 302 due to a trade-off between restricting airflow and capturing condensed water.

Referring to FIG. 5B, secondary drain pan 112 further includes a downspout 312 which is configured to funnel water condensed from evaporator 108 into an area of primary drain pan 110 that is partially surrounded by one of raised ribs 210. In some embodiments, downspout 312 includes two ends, wherein one end is coupled to drainage outlet 310 and the other end having a contour that is positioned approximate to a raised rib 210. In yet other embodiments, downspout 312 may not have a contoured end. Referring to FIG. 5C, the contour at the end of downspout 312 is at an angle 502 relative to a plane corresponding to the end in some embodiments. In some embodiments, angle 502 is approximately 45 degrees. In yet other embodiments, angle 502 may have any other appropriate value.

Note that the embodiments of secondary drain pans 112 as illustrated in FIGS. 3 and 5 are not intended to limit the scope of the present disclosure. In some embodiments, dehumidification system 100 may include more or fewer secondary drain pans 112 than those illustrated. In some embodiments, dehumidification system 100 may include only one secondary drain pan 112 comprising one or more downspouts 312.

FIG. 6A illustrates a dehumidifier drainage system 600 comprising primary drain pan 110 and secondary drain pan 112, according to certain embodiments. Secondary drain pan 112 is located partially between evaporator 108 and primary drain pan 110. Downspout 312 of secondary drain pan 112 is configured to funnel water condensed from evaporator 108 into an area of primary drain pan 110 that is partially surrounded by one of raised ribs 210. In some embodiments, downspout 312 of secondary drain pan 112 has an angle 602 relative to a vertical position. In some embodiments, angle 602 is in a range of 8-10 degrees. In yet other embodiments, angle 602 may have any other appropriate value. Angle 602 may force condensed water toward the contoured end of downspout 312.

In some embodiments, downspout 312 includes an end that is contoured and is positioned proximate to one of the raised ribs 210 of primary drain pan 110. In some embodiments, raised ribs 210 have a height of approximately ½ inch. In some embodiments, a distance 604 from the contoured end of downspout 312 to the bottom of primary drain pan 110 at a direction parallel to downspout 312 is approximately ⅛ inch. In some embodiments, a distance (e.g., 606, 608) from the periphery of downspout 312 to raised rib 210 at a direction parallel to the bottom of primary drain pan 110 is approximately ⅛ inch. In yet other embodiments, distances 604, 606, and 608 may have any appropriate values that enable creating a localized barrier in primary drain pan 110 to prevent water from being entrained in airflow 118.

Raised ribs 210 create localized regions of reduced air velocity by blocking the outlet (e.g., the contoured end) of downspout 312. Therefore, raised ribs 210 create localized low velocity airflow, which allows the water droplet to adhere to the contoured end of downspout 312 through surface tension. In this way, water droplets will drip down to primary drain pan 110 by gravity and will not be reabsorbed into airflow 118. Without raised ribs 210 on primary drain pan 110, airflow 118 flowing across primary drain pan 110 would pick up the water droplets as they fall from downspout 312. The water droplets would be reabsorbed in airflow 118, thereby defeating the purpose of dehumidification system 100 and reducing its efficiency.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A dehumidification system, comprising:

a heat exchanger;

an evaporator positioned next to the heat exchanger;

a primary drain pan disposed at least partially below the heat exchanger and at least partially below the evaporator, the primary drain pan comprising one or more raised ribs that are disposed on a bottom surface of the primary drain pan and extend upwards toward the evaporator from the bottom surface, the one or more raised ribs configured to at least partially block air flowing across the primary drain pan as the air flows from the heat exchanger into the evaporator;

a secondary drain pan disposed at least partially between the evaporator and the primary drain pan, the secondary drain pan comprising a plurality of downspouts, each downspout comprising an end that is contoured and is positioned proximate to one of the raised ribs, each downspout configured to funnel water condensed from the evaporator into an area of the primary drain pan that is at least partially surrounded by one of the raised ribs;

a condenser disposed at least partially below the primary drain pan; and an impeller disposed at least partially below the primary drain pan and adjacent to the condenser.

2. The dehumidification system of claim 1, wherein each particular one of the one or more secondary drain pans further comprises:

a second bottom, the second bottom positioned above and coupled to the downspout of the particular secondary drain pan;

one or more center ribs;

one or more intermediate ribs; and one or more back ribs.

3. The dehumidification system of claim 2, wherein the second bottom comprises:

a second drainage outlet coupled to the downspout; and a plurality of second bottom panels, wherein the plurality of second bottom panels are sloped and adjoined to allow the water condensed from the evaporator to flow to the second drainage outlet.

4. The dehumidification system of claim 3, wherein the downspout of each of the one or more secondary drain pans comprises a first end and a second end, the first end being coupled to the second drainage outlet, the second end being positioned proximate to one of the one or more raised ribs.

5. The dehumidification system of claim 4, wherein the second end comprises a contour that is at an angle relative to a plane corresponding to the second end.

6. The dehumidification system of claim 2, wherein:

the one or more center ribs are triangular in shape, and the one or more intermediate ribs and the one or more back ribs are rectangular in shape.

7. A dehumidification system, comprising:

an evaporator;

a primary drain pan disposed at least partially below the evaporator, the primary drain pan comprising one or more raised ribs, the one or more raised ribs configured to at least partially block air flowing across the primary drain pan as the air flows into the evaporator; and one or more secondary drain pans disposed at least partially between the evaporator and the primary drain pan, each of the one or more secondary drain pans comprising a downspout configured to funnel water condensed from the evaporator into an area of the primary drain pan that is at least partially surrounded by one of the raised ribs.

8. The dehumidification system of claim 7, wherein the primary drain pan further comprises:

a first bottom, wherein the one or more raised ribs are disposed on the first bottom and extend upwardly toward the evaporator from the first bottom;

a front panel extending upwardly from the first bottom;

a back panel extending from the first bottom; and a plurality of side panels extending upwardly from the first bottom.

9. The dehumidification system of claim 8, wherein the first bottom comprises:

one or more first bottom panels, wherein each of the one or more raised ribs is disposed on one of the one or more first bottom panels; and a first drainage outlet disposed on one of the one or more first bottom panels.

10. The dehumidification system of claim 9, wherein the one or more first bottom panels and the back panel are sloped at different angles to allow water to flow to the first drainage outlet.

11. The dehumidification system of claim 7, wherein the one or more raised ribs are U-shaped ribs.

12. A dehumidifier drainage system, comprising:

a primary drain pan disposed at least partially below an evaporator, the primary drain pan comprising one or more raised ribs, the one or more raised ribs configured to at least partially block air flowing across the primary drain pan as the air flows into the evaporator; and a secondary drain pan disposed at least partially between the evaporator and the primary drain pan, the secondary drain pan comprising one or more downspouts, each downspout configured to funnel water condensed from the evaporator into an area of the primary drain pan that is at least partially surrounded by one of the raised ribs.

13. The dehumidifier drainage system of claim 12, wherein the primary drain pan further comprises:

a first bottom, wherein the one or more raised ribs are disposed on the first bottom and extend upwardly toward the evaporator from the first bottom;

a front panel extending upwardly from the first bottom;

a back panel extending from the first bottom; and a plurality of side panels extending upwardly from the first bottom.

14. The dehumidifier drainage system of claim 13, wherein the first bottom comprises:

one or more first bottom panels, wherein each of the one or more raised ribs is disposed on one of the one or more first bottom panels; and a first drainage outlet disposed on one of the one or more first bottom panels.

15. The dehumidifier drainage system of claim 13, wherein the one or more first bottom panels and the back panel are sloped at different angles to allow water to flow to the first drainage outlet.

16. The dehumidifier drainage system of claim 12, wherein the one or more raised ribs are U-shaped ribs.

17. The dehumidifier drainage system of claim 12, wherein the secondary drain pan further comprises:

a second bottom, the second bottom positioned above and coupled to the downspouts of the secondary drain pan;

one or more center ribs;

one or more intermediate ribs; and one or more back ribs.

18. The dehumidifier drainage system of claim 17, wherein the second bottom comprises one or more second drainage outlets coupled to the one or more downspouts.

19. The dehumidifier drainage system of claim 18, wherein each of the one or more downspout comprises a first end and a second end, the first end being coupled to the one of the one or more second drainage outlet, the second end being positioned proximate to one of the one or more raised ribs.

20. The dehumidifier drainage system of claim 19, wherein the second end comprises a contour that is at an angle relative to a plane corresponding to the end.

* * * * *